US007614985B2

(12) United States Patent
Mosimann et al.

(10) Patent No.: US 7,614,985 B2
(45) **Date of Patent: *Nov. 10, 2009**

(54) EXERCISE DEVICE WITH BODY EXTENSION MECHANISM

(75) Inventors: Urs Mosimann, Wallenried (CH); Ulrich Schweizer, Silvaplana (CH); Vicente Morcillo-Quintero, Silla Valencia (ES); Victor Pertegaz-Esteban, Valencia (ES)

(73) Assignee: Nautilus, Inc., Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/740,082

(22) Filed: Apr. 25, 2007

(65) Prior Publication Data

US 2007/0270290 A1 Nov. 22, 2007

Related U.S. Application Data

(63) Continuation of application No. 09/848,105, filed on May 2, 2001, now Pat. No. 7,220,221.

(60) Provisional application No. 60/201,621, filed on May 3, 2000.

(51) Int. Cl.
*A63B 23/02* (2006.01)
*A63B 23/04* (2006.01)
*A63B 21/062* (2006.01)

(52) U.S. Cl. ..... 482/137; 482/100

(58) Field of Classification Search ..... 482/51, 482/72, 79, 80, 95, 96, 100, 136–138, 142, 482/146, 907

See application file for complete search history.

(56) References Cited

U.S. PATENT DOCUMENTS 3,323,366 A 6/1967 DeLorme, Jr. et al.
4,511,137 A 4/1985 Jones
4,743,010 A 5/1988 Geraci (Continued)

FOREIGN PATENT DOCUMENTS

DE 4320887 A1 * 6/1994

(Continued)

OTHER PUBLICATIONS

Body Masters MD 504 Pec Contractor & Rear Deltoid Machine, brochure, 3 pages (1994).

(Continued)

*Primary Examiner*—Loan H Thanh
*Assistant Examiner*—Victor K Hwang
(74) *Attorney, Agent, or Firm*—Dorsey & Whitney LLP

(57) ABSTRACT

An exercise device having a body extension mechanism including a press plate mechanism and an articulating seat structure. The press plate mechanism is pivotally connected to a frame forwardly of the articulating seat structure, which is also connected with the frame. The press plate mechanism is operably connected with the articulating seat structure by a transfer link so that when a user actuates the press plate mechanism, the movement of a back support of the articulating seat structure is coordinated with the movement of the press plate mechanism. Resistance for the exercise device is provided by a weight stack that is operably connected with the body extension mechanism through an arrangement of pulleys so that when the user actuates the press plate mechanism a portion of the weight stack is lifted.

19 Claims, 8 Drawing Sheets

U.S. PATENT DOCUMENTS

| | | | | | |
|---|---|---|---|---|---|
| 4,838,548 | A | | 6/1989 | Maag | |
| 5,106,081 | A | | 4/1992 | Webb | |
| 5,263,914 | A | | 11/1993 | Simonson et al. | |
| 5,366,432 | A | | 11/1994 | Habing et al. | |
| 5,484,365 | A | | 1/1996 | Jones et al. | |
| 5,527,243 | A | * | 6/1996 | Chen | 482/72 |
| 5,533,953 | A | | 7/1996 | Lui et al. | |
| 5,549,533 | A | | 8/1996 | Olson et al. | |
| 5,554,086 | A | | 9/1996 | Habing et al. | |
| 5,554,090 | A | | 9/1996 | Jones | |
| 5,580,340 | A | * | 12/1996 | Yu | 482/96 |
| 5,616,107 | A | | 4/1997 | Simonson | |
| 5,628,715 | A | | 5/1997 | Simonson | |
| 5,669,865 | A | | 9/1997 | Gordon | |
| 5,769,766 | A | | 6/1998 | Huang | |
| D431,615 | S | | 10/2000 | Webber et al. | |
| 6,220,993 | B1 | | 4/2001 | Sencil | |
| 6,264,588 | B1 | | 7/2001 | Ellis | |
| 6,287,241 | B1 | | 9/2001 | Ellis | |
| 6,296,596 | B1 | | 10/2001 | Alessandri et al. | |
| 6,605,024 | B2 | | 8/2003 | Stearns | |
| 6,743,158 | B2 | | 6/2004 | Giannelli et al. | |
| 7,004,890 | B2 | | 2/2006 | Webb et al. | |
| 7,004,891 | B2 | | 2/2006 | Morris et al. | |
| 7,070,545 | B2 | | 7/2006 | Lull et al. | |
| 7,220,221 | B2 | * | 5/2007 | Mosimann et al. | 482/100 |
| 2003/0158018 | A1 | * | 8/2003 | Giannelli et al. | 482/95 |
| 2006/0148625 | A1 | * | 7/2006 | Garner | 482/123 |
| 2006/0240957 | A1 | | 10/2006 | Lull et al. | |
| 2007/0037673 | A1 | * | 2/2007 | Giannelli et al. | 482/95 |
| 2008/0153677 | A1 | * | 6/2008 | Webber et al. | 482/96 |

FOREIGN PATENT DOCUMENTS

| | | |
|---|---|---|
| DE | G 94 11 573.7 | 9/1994 |
| DE | 298 01 626 U1 | 4/1998 |

OTHER PUBLICATIONS

Nautilus catalog, 92 pages (undated).
Nautilus® Home Gyms 2001 brochure, 12 pages (2001).
"Nautilus Next Generation Product Line", Nautilus catalog, 8 pages, (undated).
Nautilus, The Next Generation catalog, 49 pages (undated).
"Odyssey 5" Home Gym, TuffStuff, cover page of product brochure and three images therefrom, 2 pages (2001).
Schwinn® Fitness, "Harness the Force of Nature and You Possess the Strength of Confidence" brochure 32 pages (1996-1997).

* cited by examiner

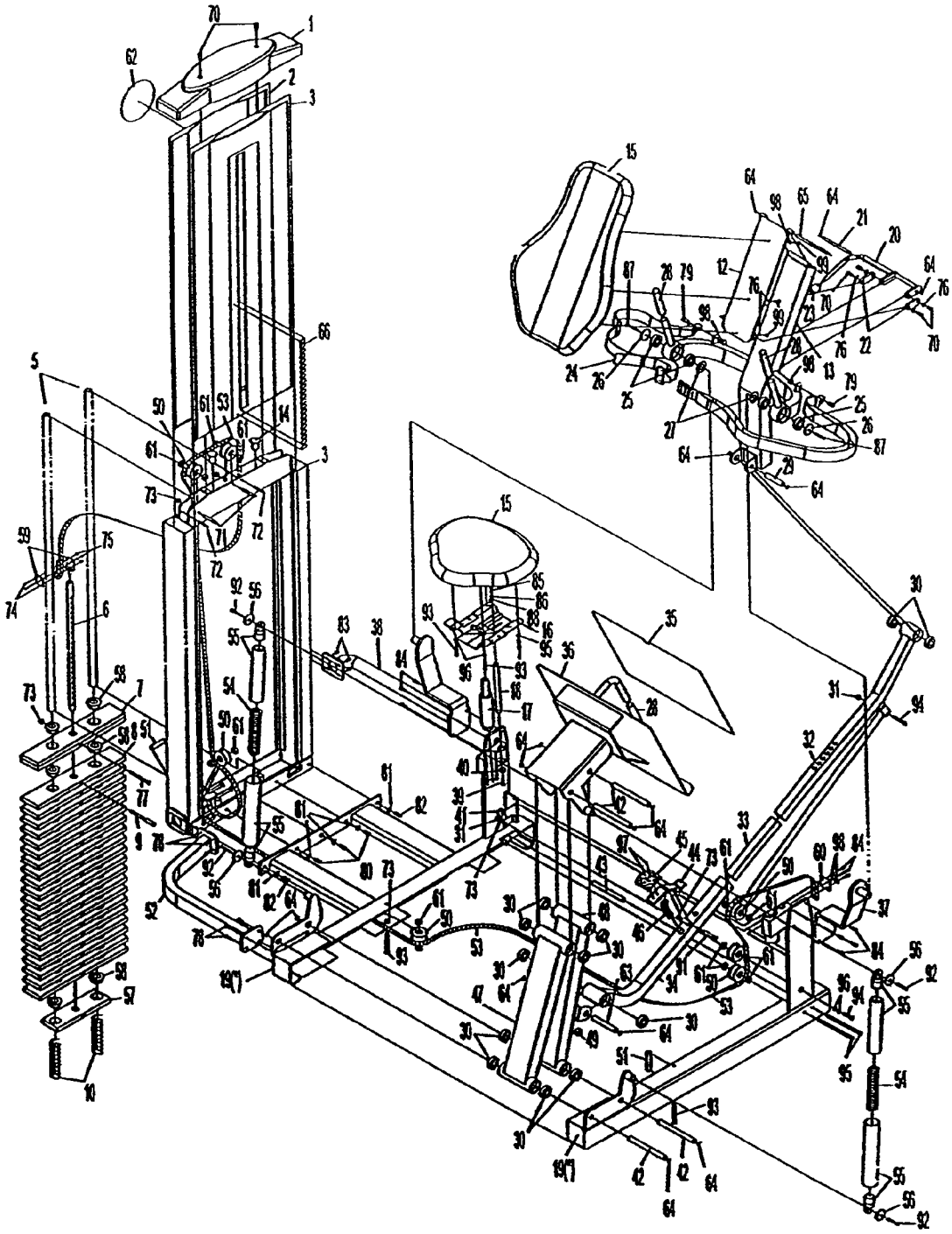
FIG.10 (APPENDIX)

EXERCISE DEVICE WITH BODY EXTENSION MECHANISM

CROSS REFERENCE TO RELATED APPLICATIONS

The present application is a continuation of co-pending U.S. application Ser. No. 09/848,105 (the '105 application), filed May 2, 2001, which claims the benefit under 35 U.S.C. § 119(e) to U.S. provisional No. 60/201,621 (the '621 application), filed May 3, 2000. The '105 and '621 applications are hereby incorporated by reference as though fully set forth herein, in their entirety.

REFERENCE TO RELATED APPLICATIONS

The present patent application is related to U.S. application Ser. No. 09/862,001, filed May 2, 2001 and entitled "Exercise Machine Providing For Natural Movement," and U.S. application Ser. No. 09/848,112, filed May 2, 2001, now U.S. Pat. No. 7,108,641, and entitled "Exercise Equipment With Multi-Positioning Handles," and are hereby incorporated by reference in their entirety. The present application claims priority from the provisional patent application No. 60/201,621 filed May 3, 2000 and entitled "Exercise Equipment With Floating Wrist Structure And A Back Extension Invention," which is hereby incorporated by reference in its entirety.

FIELD OF THE INVENTION

The present invention relates generally to the field of exercise devices. More particularly, the present invention involves an exercise device that provides a natural body extension wherein the user extends his or her legs forwardly pressing on a press plate mechanism, and a back support simultaneously and in a coordinated movement extends rearwardly.

REFERENCE TO APPENDIX

This application includes an Appendix consisting of 4 total pages. This appendix includes one figure labeled as FIG. 10 (Appendix). This figure is numbered to correspond with the associated component list which is also included in the Appendix. The contents of the Appendix are hereby incorporated by reference as though fully set forth herein.

BACKGROUND

Whether for enjoyment, for health, or for professional reasons, fitness is an important part of many peoples' lives. Many peoples' fitness routines involve the use of fitness machines such as weight machines, elliptical machines, and the like. Some of these fitness machines, however, do not provide for natural body movement during the exercise routine, which may be harmful to the user's joints and muscles. Oftentimes, the configurations of the fitness machines force the user's muscles and joints to move unnaturally. In addition, many fitness machines provide exercise for only those muscles that move some portion of the body, and mostly ignore the muscles that provide stabilization which are equally important during a person's natural movements.

It is against this background that the present invention was developed. It was recognized that natural human movements are typically natural multi-joint movements with dynamic, isolated and natural rotating movements of the extremities, with active dynamic stabilization of all joints and especially the trunk to protect the spine with all its passive structures, and that an exercise device providing natural human movement would be advantageous. It was also recognized that an exercise device providing a balance between the prime movement muscles and the stabilization muscles would be advantageous. Finally, it was recognized that close chain muscle action develops neuromuscular coordination, produce little or no sheer forces, and protects the joints with the preactivation of the joint stabilization muscles, and that an exercise device facilitating these characteristics would be advantageous. These, and other advantageous of the present invention will be evident from the following description of the present invention.

SUMMARY OF THE INVENTION

The present invention provides an exercise device with a body extension mechanism that facilitates a natural body extension for a user. The exercise device involves numerous muscle groups through either movement of the muscle or active stabilization of the muscle. In particular, the exercise device facilitates exercising the gluteus maximus, quadriceps femoris, biceps femoris, semitendinosus, semimembranosus, gastrocnemius, and soleus through movement. The exercise device facilitates exercising all trunk muscles, all muscles of the cervical region, adductor group, abductor group, sartorius, and tensor fasciae latae through stabilization.

Using the device, the user's body extends and contracts in a movement that emulates proper lifting of an object off of the ground, for example. The user is seated with their back resting on a back support, and to actuate the device presses outwardly on a press plate mechanism, which is pivotally connected with a transfer link. The transfer link is connected between an articulating seat structure, which includes the seat and back support, and the press plate. When the user presses on the press plate, the transfer link causes the back support to pivot rearwardly in a coordinated fashion with the press plate's forward movement. The coordinated movement providing a natural body extension for the user, with the user's legs simultaneously pressing outwardly while the user's back pivots rearwardly and downwardly. The user's ankles, knees, and hips are being stretched, while the user's upper body and head are actively stabilized. Additionally, the user may grasp a pair of hand grips for a close chain muscle action.

In one embodiment, the exercise device includes a frame and a body extension mechanism. The body extension mechanism includes a press plate mechanism operably connected to the frame, a seat structure having a seat and a back support, the back support being pivotally connected with the frame, and a transfer link having a first end and a second end, the first end being operably connected with the press plate mechanism, and the second end being operably connected with the back support.

In another embodiment of the present invention, the exercise device includes a frame having a front frame portion and a rear frame portion. A first transfer pulley connected with the rear frame portion, and a second transfer pulley is connected with the rear frame portion below the first transfer pulley. A third transfer pulley is connected with the front frame portion. The exercise device further includes a weight stack structure having a lower portion and an upper portion, and a weight stack having at least one weight plate. A first lift pulley is connected with the upper portion, a second lift pulley is connected with the upper portion above the weight stack, and a lower pulley is connected with the lower portion. The exercise device further includes a body extension mechanism having a press plate mechanism pivotally connected with the frame, an articulating seat structure pivotally connected with the frame, a transfer link connected between the press plate mechanism and the articulating seat structure, and a weight transfer pulley. A cable having a first end and a second end has the first end connected with the frame. The cable is routed from the connection with the frame to the weight transfer pulley, then to the first transfer pulley, then to the second transfer pulley, then to the third transfer pulley, then to the lower pulley, then to the first lift pulley, then to second lift pulley, and then the cable connected with the weight stack.

A more complete appreciation for the present invention and its scope can be obtained from understanding the accompanying drawings, which are briefly summarized below, the following detailed description of the presently preferred embodiment of the invention, and the appended claims.

BRIEF DESCRIPTION OF THE DRAWINGS

FIG. 10 is an exploded perspective view of the exercise device having numbering corresponding with the component list included herewith in Appendix A.

DETAILED DESCRIPTION OF THE PREFERRED EMBODIMENTS

Figure 1:
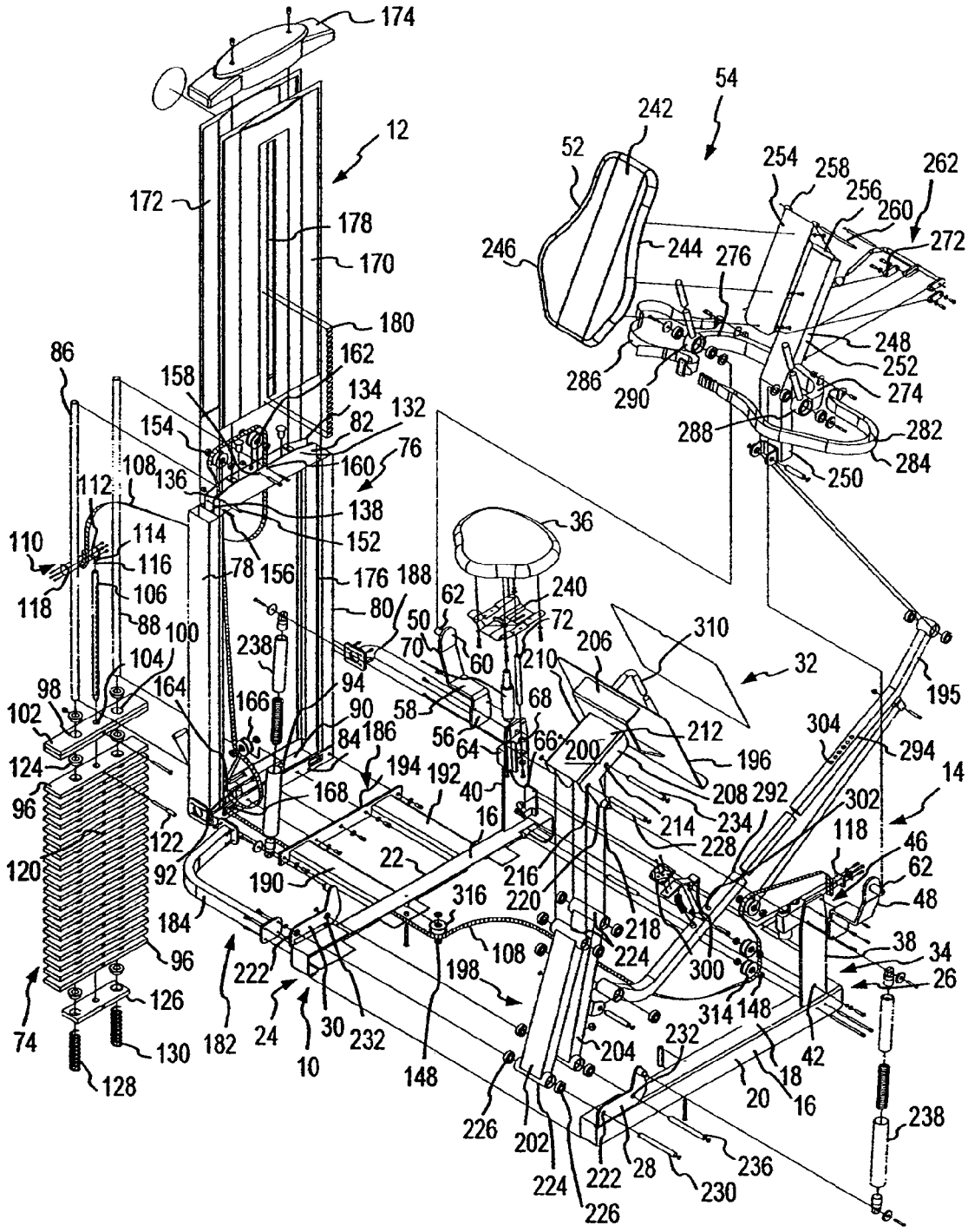
FIG. 1 is an exploded perspective view of the exercise device with a body extension mechanism according to one embodiment of the present invention.

The exercise device with a body extension mechanism of the present invention includes a main frame 10 supporting a weight stack 12 structure operably connected with a body extension mechanism 14. FIG. 1 illustrates an exploded view of the main frame 10 supporting the weight stack structure 12 and the body extension mechanism 14. For purposes of this description, the perspective of a user seated on the device will be used to describe the device wherever appropriate. For example, from the perspective of a user, the weight stack structure 12 is to the right and hence on the right side of the device. In one embodiment, the main frame 10 extends from the front of the device rearwardly to the rear of the device and includes a lower frame member 16. The lower frame member 16 defines a top 18, a left side 20, a right side 22, a front portion 24, and a rear portion 26. A left pivot mounting bracket 28 and a right pivot mounting bracket 30 are attached with the front left portion (20, 24) of the lower frame member 16 and with the front right portion (22, 24) of the lower frame member respectively. The pivot mounting brackets (28, 30) pivotally support a press plate mechanism 32 as is described in more detail below.

Referring to FIGS. 1, 3, 4, 7, and others, an upright seat support post 34 is connected with the rear portion 26 of the lower frame member 16 and extends generally transversely and upwardly therefrom to support a seat 36 thereto. The upright seat support post 34 includes a left post bracket 38 and a right post bracket 40 each preferably defining a lower aperture 42 for mounting a first transfer pulley 44 and four upper threaded apertures 46 arranged in a rectangular configuration for mounting a left back support pivot bracket 48 and right back support pivot bracket 50 respectively. The left and right back support pivot brackets (48, 50) provide a pivotally mounting structure for a back support 52 of an articulated seat structure 54 as is described in more detail below. The back support pivot brackets (48, 50) include a mounting portion 56 defining four apertures adapted to align with the corresponding four threaded apertures 46 in the left and right post brackets (38, 40), and to be fixed thereto preferably using bolts adapted to engage the threaded apertures 46. Above the mounting portion 56, the back support pivot brackets (48, 50) also define an outwardly extending portion 58, and an upwardly extending portion 60 terminating at a back support pivot post 62 extending transversely from the upwardly extending portion 60 so that the articulate seat structure 54 may pivot thereabout.

A seat support housing 64 is mounted between the left post bracket 38 and the right post bracket 40 adjacent the upper portion of the seat support post 34. The seat support housing 64 defines an air shock cylinder 66 and a guide rod cylinder 68 adapted to support an air shock 70 and a guide rod 72 respectively. As will be explained in greater detail below, the air shock 70 provides a seat height adjustment mechanism, and the guide rod 72 prohibits rotation of the seat 36 about the air shock 70.

The weight stack structure 12 generally refers to the structure that houses a weight stack 74 and is preferably connected on the right side of the device with the right side of the main frame 10. Preferably, the lower portion of the weight stack structure 12 rests on the floor and extends upwardly therefrom. In one embodiment, the weight stack structure 12 includes a weight stack housing 76 having a front upwardly extending frame member 78 and a rear upwardly extending frame member 80. An upper frame member 82 extends between the upper portion of the front and rear upwardly extending frame members (78, 80), and a lower frame member 84 extends between the lower portions of the front and rear upwardly extending frame members (78, 80). The upper frame member 82 includes a bottom portion (not shown) defining a front guide aperture and a rear guide aperture (not shown) adapted to cooperate respectively with a front guide member 86 and a rear guide member 88 of the weight stack 74. The lower frame member 84 includes a base portion 90 defining a front guide post 92 and a rear guide post 94, each extending upwardly from the base portion 90 and generally transverse to the base portion. The front guide post 92 and the rear guide post 94 are adapted to cooperate with the front guide member 86 and the rear guide member 88 respectively, of the weight stack 74.

The weight stack 74 defines a plurality of plates 96, each preferably being the same weight. such as 10 lb., which are generally oriented between the front frame member 78 and the rear frame member 80. The front guide member 86 extends between the front guide post 92 and the front guide aperture, and the rear guide member 88 extends between the rear guide post 94 and the rear guide aperture. Each plate 96 defines a first guide aperture 98 and a second guide aperture 100 extending between a top face of the plate 102 to a bottom face of the plate (not shown), and adapted to cooperate with the front guide member 86 and the rear guide member 88 respectively. Each plate 96 also defines a weight selection bar aperture 104 located between the first guide aperture 98 and the second guide aperture 1 00, and adapted to cooperate with a weight selection bar 106.

The top of the weight selection bar 106 is connected with a cable 108, which is connected with the body extension mechanism 14, and thereby translates the movement of the body extension mechanism 14 to raising or lowering the weight stack 74 as is described in more detail below. In one embodiment, a retention structure 110 connects with the top of the weight selection bar 106. Preferably, the retention structure 110 includes a first retention plate 112 having a lower forwardly extending flange 114 and defining four apertures in a generally rectangular arrangement. A threaded post 116 extends downwardly from the first retention plate 112 that is adapted to engage a threaded aperture defined by the top portion of the weight selection bar 106 and is thereby fixed to the weight selection bar. A second retention plate 118 defines four apertures configured to correspond with the four aperture of the first retention plate 112. Preferably, the second retention plate 118 fits within the area defined by the first retention plate 112 above the flange 114. The cable 108 is looped downwardly between the first 112 and second 118 plates so that the looped portion extends below the plates. The plates (112, 118) are bolted together to hold the cable 108. Preferably, the flange 114 pinches the cable 108, which provides additional retention strength of the cable to the weight selection bar.

To engage the appropriate amount of weight for exercise, each plate 96 defines a weight pin aperture 120 extending generally transversely from the weight selection bar aperture 104 to the left face of the plate. A weight selection pin 122 may be inserted through the weight pin aperture 120 to engage the weight selection bar 106, which thereby engages the plate associated with the selected aperture. For example, if the users selects the $5^{th}$ plate from the top of the weight stack 74, the user will lift the $5^{th}$ plate and the four plates above it during exercise, e.g., 50 lb.

During exercise, the plates 96 move upwardly and downwardly along the guide members (86, 88) between a lower position and an upper position. Preferably, the first 98 and second 100 apertures include a bushing 124 fit therein adapted to engage the guide members and to facilitate a smooth upward and downward motion of the weight stack 74. Preferably, the weight stack 74 includes a base plate 126 having the first guide aperture 98 and the second guide aperture 100 adapted to cooperate with the front guide member 86 and the rear guide member 88 respectively. A front spring 128 and a rear spring 130 are fit over the front guide member 86 and the rear guide member 88 respectively, and over the front guide post 92 and the rear guide post 94 respectively and extend between the base portion 90 of the weight stack housing 76 and the base plate 126. When a user is exercising, the springs (128, 130) extend upwardly as the weight stack 74 is moved upwardly by the user, and the springs (128, 130) are compressed as the weight stack 74 is moved downwardly by the user. The springs provide a shock absorbing function in the event that the user allows the weight stack to return to the downward position too vigorously, which shock absorbing function eases wear and tear on the machine generally.

Figure 2:
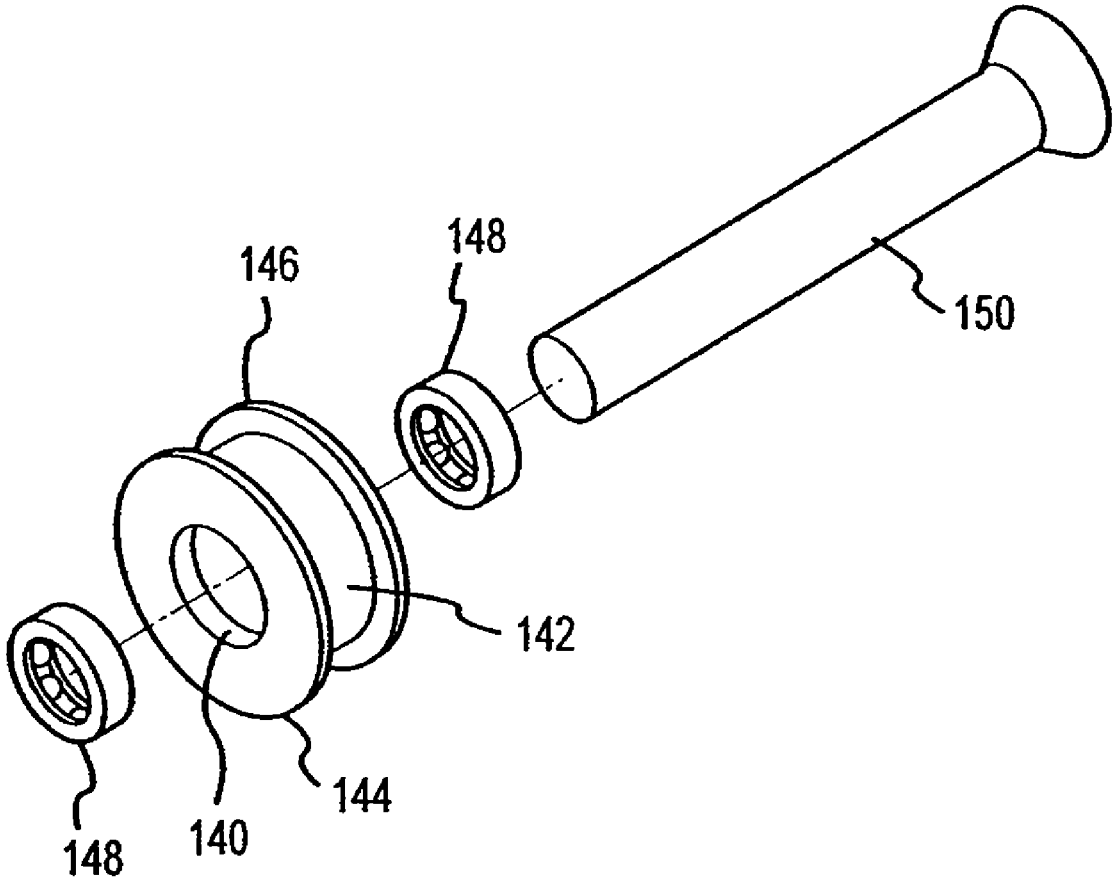
FIG. 2 is an exploded perspective view of a pulley according to one embodiment of the present invention.
Figure 3:
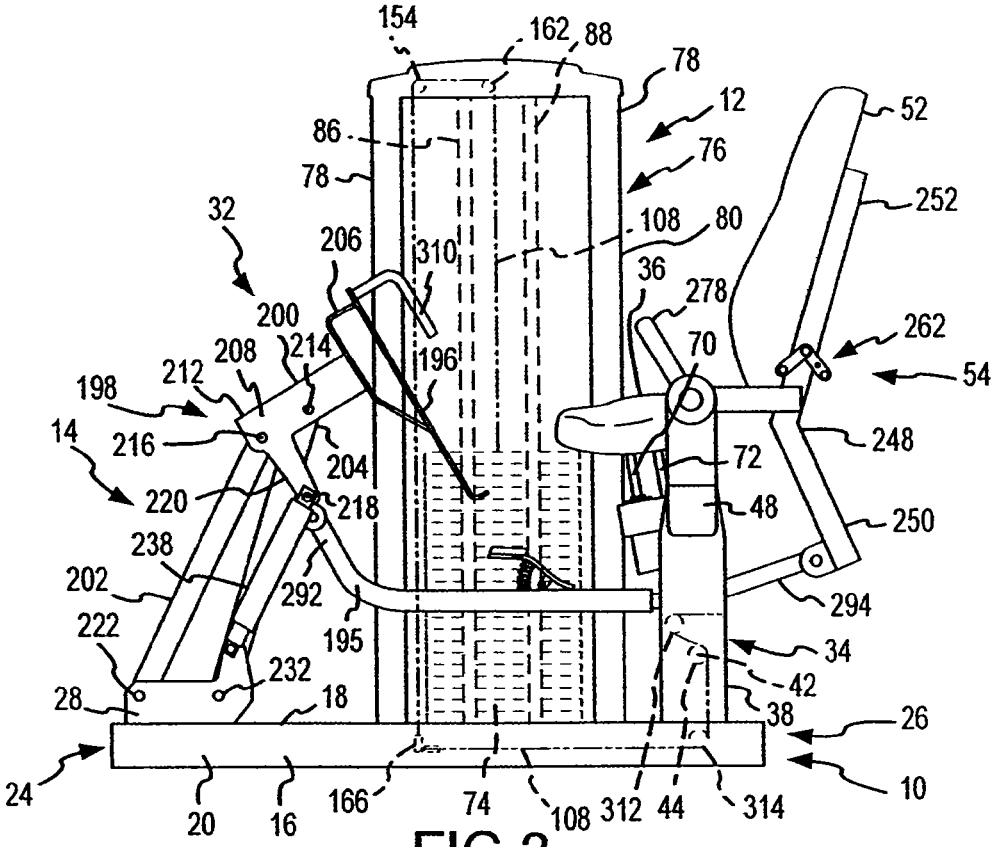
FIG. 3 is a side view of the exercise device with a body extension in an unextended position according to one embodiment of the present invention.

Referring again to the upper frame member 82 of the weight stack structure 12, the upper frame member 82 includes a left plate 132 and a right plate 134 connected at about a right angle with the bottom portion. The front portions of the left plate 132 and the right plate 134 each define a front lift pulley aperture 136 and a front retention pin aperture 138 forwardly of the front lift pulley aperture 136. In one embodiment of the present invention, which uses a cable having a generally rectangular cross-section, a number of pulleys in various configurations are used for directing the cable 108. Referring to the pulley illustrated in FIG. 2, preferably each pulley defines a pivot cylinder 140 for pivotally mounting the pulley to the device. In use, the cable 108 engages a circumferential channel 142, which is defined by a first circumferentially extending flange 144 and a second circumferentially extending flange 146 on each side of the channel 142. The channel 142 defines a generally flat surface to engage the cable 108. Alternatively, if a cable having a round cross section is used, then the channel preferably defines a downwardly concave surface to engage the cable. In one embodiment, one or more bushings or bearing rings 148 are fit in the pivot cylinder 140 to provide smooth rotation of the pulley about a pivot pin 150, which provides a pulley axle.

Referring again to FIG. 1 and others, a pivot pin 152 extends between the front lift pulley apertures 136 and pivotally supports a front lift pulley 154. The pivot pin 152 provides the pulley axle for the front lift pulley 154. A first retention pin 156 extends between the front retention pin apertures 138 and is adapted to prevent the cable 108 from running off the pulley 154 during use. Preferably, the retention pin 156 is located adjacent an outside edge of the circumferential flanges (144, 146) and thereby deflects the cable 108 back into the channel 142 if the cable 108 rides up on either flange. Preferably, the retention pin 156 is located close enough to the pulley 154 so as to not interfere with its operation, but to also prevent the cable 108 from riding up on the flange and between the flange and the retention pin. In one embodiment, the retention pin 156 rotates in the retention pin apertures 138 when the cable engages it, and thereby minimizes any resistance therebetween.

The mid-portion of the left plate 132 and the right plate 134 each define a center lift pulley aperture 158 and a rear retention pin aperture 160 rearwardly of the center lift pulley apertures 158. A pivot pin extends between the center lift pulley apertures 158, and pivotally supports a center lift pulley 162. A second retention pin extends between the rear retention pin apertures 160 and is adapted to prevent the cable from running off the center lift pulley 162 during use in substantially the same manner as is described above with regard to the front retention pin 156.

Referring again to the lower frame member 84 of the weight stack structure 12, a lower pulley mounting bracket 164 extends upwardly from the base portion 90 adjacent the front frame member 78. The lower pulley mounting bracket 164 defines a rear lower pulley mounting aperture and a rear retention pin aperture to the right of the rear lower pulley mounting aperture. The lower inside portion of the front upwardly extending frame member 78 defines a front lower pulley mounting aperture (not shown) in alignment with the rear lower pulley mounting aperture and a front retention pin aperture in alignment with the rear retention pin aperture. A lower pulley pin extends between the front lower pulley mounting aperture and the rear lower pulley mounting aperture and pivotally supports a lower pulley 166. A lower retention pin extends between the rear retention pin aperture and the front retention pin aperture. As discussed above, the lower retention pin helps to prevent the cable from running out of the lower pulley.

In one embodiment, the cable 108 extends upwardly from the top of the weight selection bar 106 at the top portion of the weight stack 74, and engages the center lift pulley 162. From the center lift pulley 162, the cable 108 extends forwardly along the length of the upper frame member 82 and engages the front lift pulley 154. From the front lift pulley 154, the cable 108 is directed downwardly toward the bottom portion of the weight stack housing 76 and engages the lower redirecting pulley 166, where the cable 108 is directed substantially transversely of the downward path between the front lift pulley 154 and the lower pulley 166 toward the front portion of the main frame 10. Preferably, the left plate of the lower frame member 84 defines an elongate rectangular aperture 168 and the cable 108 is routed therethrough toward the main frame 10.

In one embodiment of the invention, the weight stack structure 12 and the weight stack 74 supported therein, is covered by a left facie 170, a right facie 172, and a top cap 174. The left and right facie (170, 172) provide both a decorative covering, and also substantially prevent the user from inadvertently placing a finger in between the plates 96 and thereby reduces the potential for an injury that a user might experience. Preferably, a left facie retention channel is defined by an inwardly extending flange 176 running along the inside length of each frame member (78, 80) and the left plate 132 of the upper frame member 82 at the top of the weight stack, and the inwardly extending flange 176 and a retention tab (not shown) extending inwardly from the lower portion of each frame member. The outside edge of the left facie 170 is adapted to fit within the left channel and is thereby held in place on the left side of the weight stack. Similarly, a right facie retention channel is defined on the right side of the weight stack structure 12 to retain the right facie 172. The cap 174 fits around the top of the left 170 and right 172 facie, and is bolted preferably to the top of each guide member (86, 88). The left facie 170 defines an elongate slot 178 extending from the bottom portion of the facie 170 to the top portion of the facie 170, and is located to provide the user with access to the weight selection bar 106. Preferably, a plurality of weight indicator labels 180 are located adjacent the elongate slot 178. The indicator labels 180 are arranged so that each label, e.g., a 30 lb label, is located next to the appropriate plate 96 when the weight stack 74 is in the lower position.

A connection structure 182 connects the weight stack structure 12 with the main frame 10, and stably maintains the weight stack structure 12 in its upright configuration. The connection structure includes a front arcuate support beam 184, a center support structure 186, and a rear arcuate support beam 188. The front actuate support beam 184 is connected to the lower front portion of the front frame member 78, and extends outwardly therefrom. From the front frame member 78, the front arcuate support beam 184 arcs leftward and is connected with the front right portion (22, 24) of the main frame 10.

The center support structure 186 includes a front beam 190 and a rear beam 192 with a bracket 194 extending between the right end of the front beam 190 and the right end of the rear beam 192. The center support structure 186 is connected between the lower frame member 84 of the weight stack structure 12 and the right side 22 of the main frame 10. In one embodiment, the front beam 190 defines a channel in alignment with the elongate rectangular aperture 168 in the left side wall of the lower frame member 84, the channel extending from the right side of the connection structure 182 to the left side of the connection structure 182 and adapted for the cable 108 to extend therethrough.

The rear arcuate support beam 188 is connected to the lower rear portion of the rear frame member 80 of the weight stack structure 12, and extends outwardly therefrom. The rear support beam 188 defines an elbow portion adjacent the connection with the rear frame member. From the elbow portion, the rear support beam 188 extends to the rear of the main frame 12 and is connected therewith. In one embodiment, the portion of the rear support beam 188 adjacent the connection to the main frame 12 includes the right back support pivot bracket 50.

The body extension mechanism 14 includes a transfer link 195 connecting the press plate mechanism 32 with the articulated seat structure 54. During exercise, the user sitting on the articulated seat structure 54 places his or her feet on the press plate mechanism 32 and presses forwardly, which causes the press plate mechanism 32 to pivot forwardly thereby pulling on the transfer link 195. The cable 108 is connected with the transfer link 195, which lifts a selected weight upwardly when the user pushes forwardly on the press plate mechanism 32. In addition, the transfer link 195 is connected with the articulated seat structure 54, which causes the back support 52 of the articulated seat structure 54 to pivot rearwardly when the user pushes forwardly on the press plate mechanism 32.

The press plate mechanism 32 includes a foot plate 196 that is pivotally connected with the top front portion (18, 24) of the main frame 10. In one embodiment, the foot plate 196 is pivotally connected with the main frame 10 in a four bar linkage configuration 198 having a top link 200, a front link 202, and a rear link 204. The foot plate 196 is connected with the top link 200 by a plate support bracket 206. Preferably, the top link 200 defines a generally unshaped cross section having a left side wall 208, a right side wall 210, and a top 212. The sidewalls (208, 210) each define a top rear pivot aperture 214, a top front pivot aperture 216, and a shock mounting post 218. The top rear pivot aperture 214 is preferably located about midway along the length of the top link 200, and the top front pivot aperture 216 is preferably located forwardly of the top rear pivot aperture 214 and adjacent the front portion of the top link 200. The lower front portion of the left 208 and right 210 sidewalls each define a downwardly extending ear 220 with the shock mounting post 218 extending outwardly from the lower portion of the ear.

The top of the front link 202 is pivotally connected to the top link 200 between the front pivot apertures 216, and the bottom of the front link 202 is pivotally connected to the main frame 10 between the front pivot apertures 222 defined by the pivot mounting brackets (28, 30). In particular, the top portion and the bottom portion of the front link 202 define an elongate cylinder 224 generally transverse to the length of the front link 202. The top cylinder fits between the top front apertures 216 in the left side wall 208 and the right side wall 210 of the top link 200. The bottom cylinder fits between the left and right pivot mounting brackets (28, 30). Preferably, a pivot bearing 226 fits within each end of the cylinders 224. The top of the front link 202 is pivotally connected to the top link 200 with a pivot pin 228 that extends through the top front pivot apertures 216 engaging the pivot bearings 226 and thereby pivotally supporting the top of the front link 202. The bottom of the front link 202 is pivotally connected with the main frame 10 with a pivot pin 230 extending through the front pivot apertures 222 of the pivot mounting brackets (28, 30) and engaging the pivot bearings 226 and thereby pivotally supporting the bottom of the front link 202.

The top of the rear link 204 is pivotally connected to the top link 200 at the rear pivot apertures 214, and the bottom of the rear link 204 is pivotally connected to the main frame 10 at the rear pivot apertures 232 of the pivot mounting brackets (28, 30). The pivotal connection of the rear link 204 with the top link 200 and with the pivot mounting brackets (28, 30) is substantially similar to the pivotal connection of the front link 202 as described above. As with the front link 202, the top portion and the bottom portion of the rear link 204 define a cylinder 224 adapted to fit between the left side wall 208 and the right side wall 210 of the top link 200 and between the left pivot mounting bracket 28 and the right pivot mounting bracket 30 respectively. A pivot pin 234 extends through the rear pivot apertures 214 of the top link 200 and engages the pivot bearings located in the ends of the top cylinder, and thereby pivotally supports the top of the rear link 204. In addition, a pivot pin 236 extends through the rear pivot apertures 232 of the pivot mounting brackets (28, 30) and engages the pivot bearings located in the ends of the bottom cylinder, and thereby pivotally supports the bottom of the rear link 204.

In one embodiment, the forward and rearward pivotal motion of the press plate mechanism 32 is smoothed out by a gas shock 238 pivotally connected to the press plate mechanism 32 and pivotally connected to the main frame 10. Preferably, a first gas shock is connected between the left pivot mounting bracket 28 and the left side 208 of the top link 200, and a second gas shock is connected between the right pivot mounting bracket 30 and the right side 210 of the top link 200. The shocks 238 provide a smoothing function to both the forward and the rearward movement. In addition, when the press plate mechanism 32 is pressed forwardly, the gas shocks 238 prohibit a rapid rearward acceleration should the user have difficulty performing the body extension. Alternatively, other damping devices such as springs, oil shocks, and the like may be used in substantially the same configuration as the gas shocks 238 to smooth the extension and compression of the exercise device.

The top link 200, front link 202, rear link 204, and frame 10 are all pivotally attached together, as described above, to move as a four-bar link system 198. The frame portion of the four-bar link system acts as an anchor, relative to which the other three links move. In the rest position, the footplate 196 is angled downwardly and toward the user, which means the heels of the user are closer to the user's body than the user's toes. The four-bar link system 198 is angled toward the user, with the top of the link 204 closest to the user extending further upwardly than the top of the link 202 furthest from the user. The plate support bracket 206 thus extends upwardly and toward the user, with the footplate 196 attached to the plate support bracket and extending, as above, downwardly and toward the user. In moving to the full extension position, the front and rear links (202, 204) pivot about their respective connection to the frame 10 and angle slightly forwardly away from the frame. The tops of each of the front and rear links are at approximately the same height (although since the rear link is longer it is at more of an angle than the front link). The plate support bracket 206 extends substantially parallel to the floor, and the footplate 196 extends substantially vertically relative to the floor. The user's heels are now about the same distance away from the user as the user's toes. This helps stretch out the calf muscles and replicate the action of standing up from a crouch.

The articulating seat structure 54 includes the seat 36 and the back support 52. A seat bracket 240 is connected to the underside of the seat 36. The underside of the seat bracket (not shown) defines an air shock receptor for receiving the top of the air shock 70, and also defines a guide rod receptor for receiving the top of the guide rod 72. An air shock actuation lever is connected with the air shock adjacent the seat bracket 240. As is well known in the art, the air shock lever controls the up and down movement of the air shock 70 and the seat 36 connected therewith. Pressing downward on the air shock lever unlocks the air shock 70. In the unlocked position, if downward pressure is placed on the seat 36, then the seat will move downwardly, and if little or no downward pressure is placed on the seat 36, then the seat will move upwardly. Accordingly, the user may adjust the height of the seat 36. By releasing the air shock lever the air shock 70 locks in position. The guide rod 72 prohibits rotation of the seat 36 about the air shock 70. Preferably, the seat is fixed along the length of the main frame 10.

In one embodiment, the back support 52 defines a middle portion 242, a left wing 244, and a right wing 246. Preferably, the middle portion 242 is configured to align generally with the center of the user's back along the spine. Preferably, the left wing 244 extends outwardly and forwardly from the left side of the middle portion 242, and the right wing 246 extends outwardly and forwardly from the right side of the middle portion 242. The wings are configured to hug the user in the back support 52 and to thereby provide lateral stability for the user.

The back support 52 is attached with an articulating seat member 248, which is pivotally connected with the main frame 10. In particular, the articulating seat member 248 defines a lower actuation arm portion 250 and a back member portion 252 extending upwardly and rearwardly from the lower actuation arm portion 250. A back support plate 254 is preferably pivotally connected with the back member portion 252, and the back support 52 is bolted to the back support plate 254. In one embodiment, the upper front edge of the back member portion 252 includes a pivot cylinder 256, and the upper rear portion of the back support plate 254 defines corresponding pivot cylinders 258 configured to align with the left and right ends of the pivot cylinder 256 at the top of the back member 252. A pivot rod 260 extends through the pivot cylinders (256, 258) to pivotally connect the back member 252 with the back support plate 254.

Figure 5:
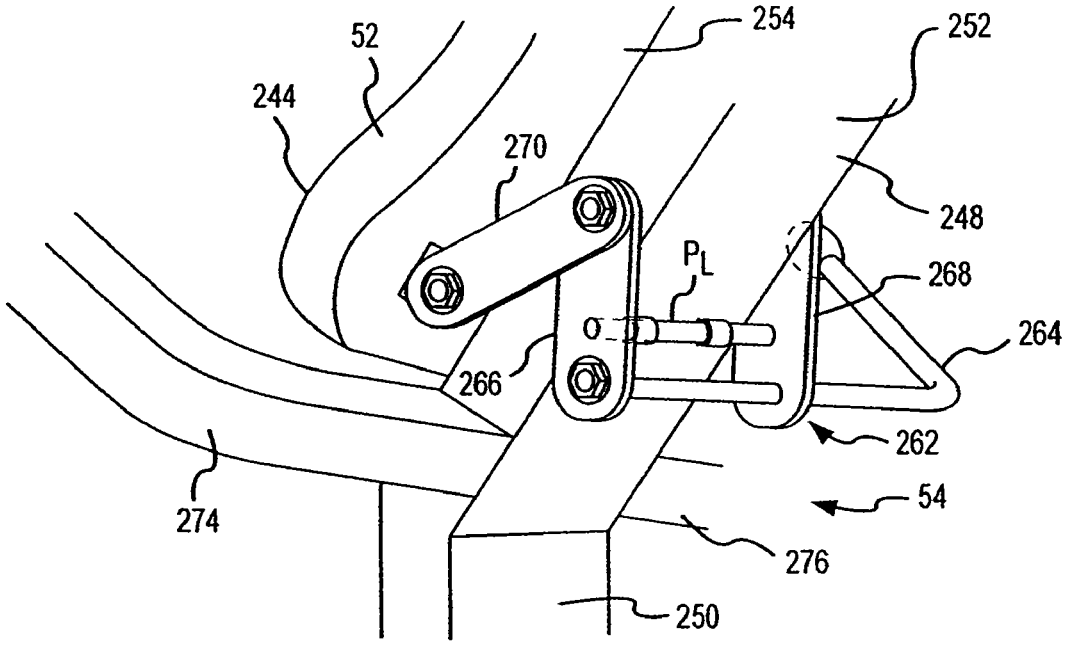
FIG. 5 is a side view of the seat back adjustment mechanism with the seat back in a rearward orientation according to one embodiment of the present invention.
Figure 6:
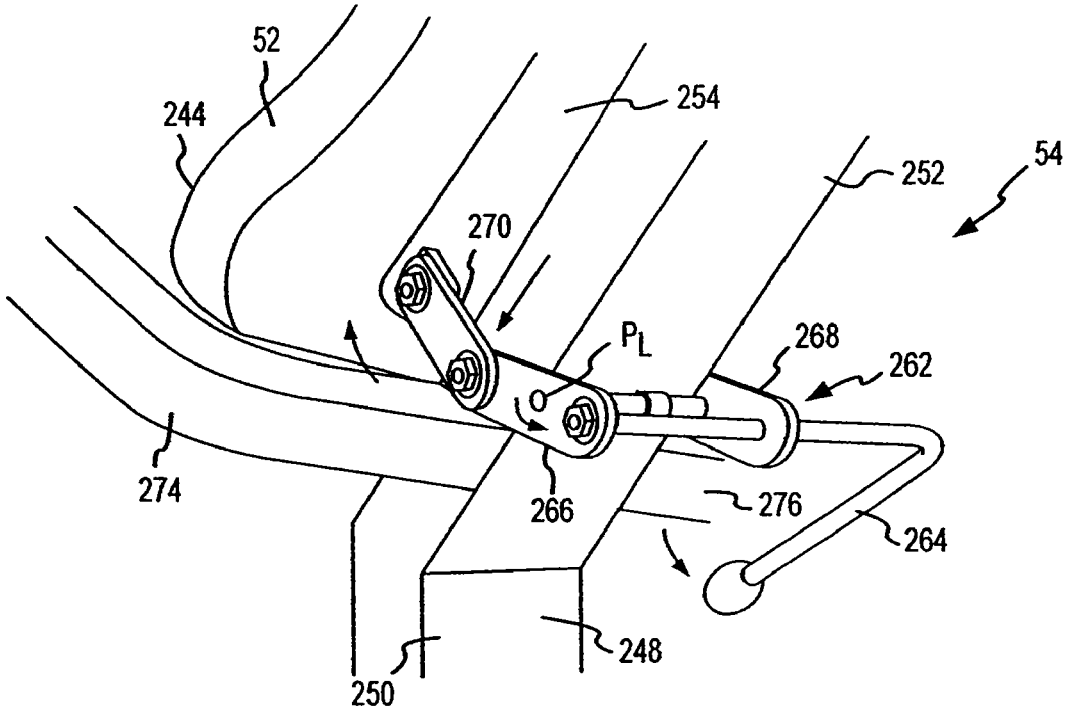
FIG. 6 is a side view of the seat back adjustment mechanism with the seat back in a forward orientation according to one embodiment of the present invention.

Referring to FIGS. 5 and 6, which illustrate a back support adjustment mechanism 262, the back support plate 254 and hence the back support 52 connected therewith may be adjusted between a forward position (shown in FIG. 6) and a rearward position (shown in FIG. 5) by actuation of the over-center back support adjustment mechanism 262 which pivots the back support 52 forwardly or rearwardly. The over-center back support adjustment mechanism 262 includes an adjustment arm 264 having a left rear over-center link 266 and a right rear over-center link 268 fixed thereto. The left rear over-center link 266 is pivotally connected with a left front over-center link 270, and the right rear over-center link 268 is pivotally connected with a right front over-center link 272. The rear over-center links (266, 268) are also pivotally connected PL with the lower left side of the back member portion 252 of the articulating seat member between about midway along the length of the rear over-center links (266, 268). The left front over-center link 270 is pivotally connected with the lower left portion of the back support plate 254, and the right front over-center link 272 is pivotally connected with the lower right portion of the back support plate 254.

To adjust the back support 52 between the forward and the rearward position, the adjustment arm 264 is rotated forwardly or rearwardly respectively. In the rearward position shown in FIG. 5, the rear over-center links (266, 268) are oriented upwardly toward the pivotal connection with the front over-center links (270, 272), and the front over-center links are oriented downwardly between the pivotal connection with the rear over-center links and the pivotal connection with the back support plate 254. In the rearward position, the angle between the rear over-center links (266, 268) and the front over-center links (270, 272) is preferably greater than 180 degrees. To pivot the lower portion of the back support plate forward as shown in FIG. 6, the adjustment arm 264 is rotated forwardly. When rotated forwardly, the pivotal connection between the rear over-center links (266, 268) and the front over-center links (270, 272) moves downwardly past center. In the forward position, the angle between the rear over-center links and the front over-center links moves from greater than 180 degrees to less than 180 degrees. In addition, the pivotal connection between the front and rear over-center links preferably abuts the top of an arcuate arm (274, 276). The over-center link configuration holds the back support 52 in the forward position due to the rearward and downward force on the front over-center links from the back support and the abutment.

The left arcuate arm 274 and the right arcuate arm 276 extend outwardly and forwardly from the left lower portion and right lower portion, respectively, of the back member portion 252. A left hand grip 278 and a right hand grip 280 extend upwardly and outwardly from the end of the left arcuate arm 274 and the right arcuate arm 276 respectively. Preferably, the hand grips (278, 280) are configured so that a user seated on the seat 36 may grasp the hand grips during exercise.

In one embodiment, the device includes a lap belt 282 for the user. The lap belt 282 includes a left portion 284 and a right portion 286, with the left portion having a receptacle and the right portion having a plug to secure the left portion 284 to the right portion 286 about the user. Preferably, the left portion is connected with rear portion of the left arcuate arm 274, and the right portion is connected with the right arcuate arm 276.

The forward end of the left arcuate arm 274 defines a left back support pivot housing 288, and the forward end of the right arcuate arm 276 defines a right back support pivot housing 290. In one embodiment, the left back support pivot post 62 which extends outwardly from the top portion of the left back support pivot bracket 48, engages the left back support pivot housing 288, and the right back support pivot post 62, which extends outwardly from the top portion of the right back support pivot bracket 50, engages the right back support pivot housing 290. In this configuration, the back support 52 may pivot forwardly or rearwardly about the back support pivots 288, 290. Preferably, the ends of the pivot posts 62 define a threaded aperture. A pair of bushings or pivot bearings are fitted within the back support pivot housings, as described above, and a washer is fit next to each bearing adjacent the left outside edge and the right outside edge of the back support pivot housings. The pivot post 62 engages the bushings inserted in the back support pivot housings (288, 290) and a bolt engages the threaded apertures to hold the posts 62 in the pivot housings (288, 290).

The seat back support pivotally moves with respect to the back support pivots. The seat back support is attached to the articulating seat member 248, which defines a lower actuation arm 250. The lower actuation arm, as described in more detail below, is attached to the transfer link 195, so that when the transfer link moves, the seat back pivots about the back support pivots. This causes the user, resting against the seat back support, to recline or incline according to the drive direction of the transfer link. As described below in more detail, the amount the seat back reclines is tied directly to the distance the footplate is moved.

The transfer link 195 provides a coordinating mechanism between the movement of the press plate mechanism 32 and the articulation of the seat structure 54. The front end of the transfer link 195 is pivotally coupled with the rear link 204, and the rear end of the transfer link 195 is pivotally coupled with the lower front portion of the actuation arm portion 250 of the articulating seat member 248. Preferably, the transfer link 195 is pivotally coupled to the rear link 204 and to the actuation arm 250 in substantially the same manner as described herein with regard to the pivotal coupling of the front link 202 to the top link 200 and the pivotal coupling of the front link 202 to the pivot mounting brackets (28, 30), for example.

The transfer link 195 includes a front portion 292 and a rear portion 294. The front portion 292 defines a downwardly and rearwardly extending arc from the front end of the transfer link 195, and defines a generally straight section extending rearwardly from the arc. Preferably, the straight section of the front portion 292 defines a channel that the rear portion 294 is inserted within so that the length of the transfer link 195 may be adjusted by extending the rear portion 294 rearwardly or moving the rear portion 294 forwardly in the channel. The rear portion 294 defines a downwardly and forwardly extending section from the pivotal connection with the actuation arm member 250, and defines a generally straight section adapted to engage the channel defined by the front portion 292.

Preferably, a transfer link length adjustment pedal 296 is connected with the front portion 292 of the transfer link 195. The adjustment pedal includes a pedal member 298 having a front portion and rear portion. The pedal member 298 is pivotally connected with the top of the front portion 292 of the transfer link 195. Preferably, a pin 300 extends downwardly from the rear portion of the pedal member 298 to engage a set hole 302 in the top of the transfer link 195 below the pedal 298. The set hole 302 preferably corresponds with a plurality of adjustment holes 304 located in the rear portion 294 of the transfer link 195. When the rear portion 294 of the transfer link 195 is inserted within the channel defined by the front portion 292 of the transfer link, one of the adjustment holes 304 may be aligned with the set hole 302, and the downwardly extending pin 300 of the pedal inserted into the set hole 302 to engage one of the adjustment holes 304 and thereby fix the overall length of the transfer link 195. Preferably, a spring 306 is located between the front portion of the pedal member 298 and the front portion 292 transfer link, the spring acting to bias the pin 300 into the set hole 302. A foot pad 308 is fixed to the front portion of the pedal member 298 so that a user may press downwardly on the front portion of the pedal member, which in turn causes the pedal member to pivot about the pivotal connection with the transfer link 195 and accordingly moves the rear portion of the pedal member upwardly and disengages the pin 300 from the set hole 302. After which the user may adjust the length of the transfer link 195 and hence the user's position on the machine.

The adjustment pedal 296 generally provides an easily controllable way to adjust the length of the transfer link 195. For example, the user may press downwardly on the pedal 296, and at the same time press outwardly on the press plate 196 to lengthen the transfer link. To shorten the transfer link, the user may press downwardly on the pedal 296, and at the same time grasp a handle 310 attached to the press plate 196 and pull the press plate rearwardly.

The weight transfer pulley 312 that actuates the load to be applied during the exercise motion, or the load pulley, is attached to the transfer link 195. The load pulley 312 is attached to the bottom of the transfer link by a bracket, and is oriented to rotate in a plane extending along the length of the transfer link (the pivot axis is transverse to the transfer link). The belt 108 or cable of the cable pulley system wraps around the load pulley, so when the transfer link is moved (due to the movement of the foot plate), the load pulley 312 moves correspondingly, thus extending the belt and lifting the selected load.

Figure 8:
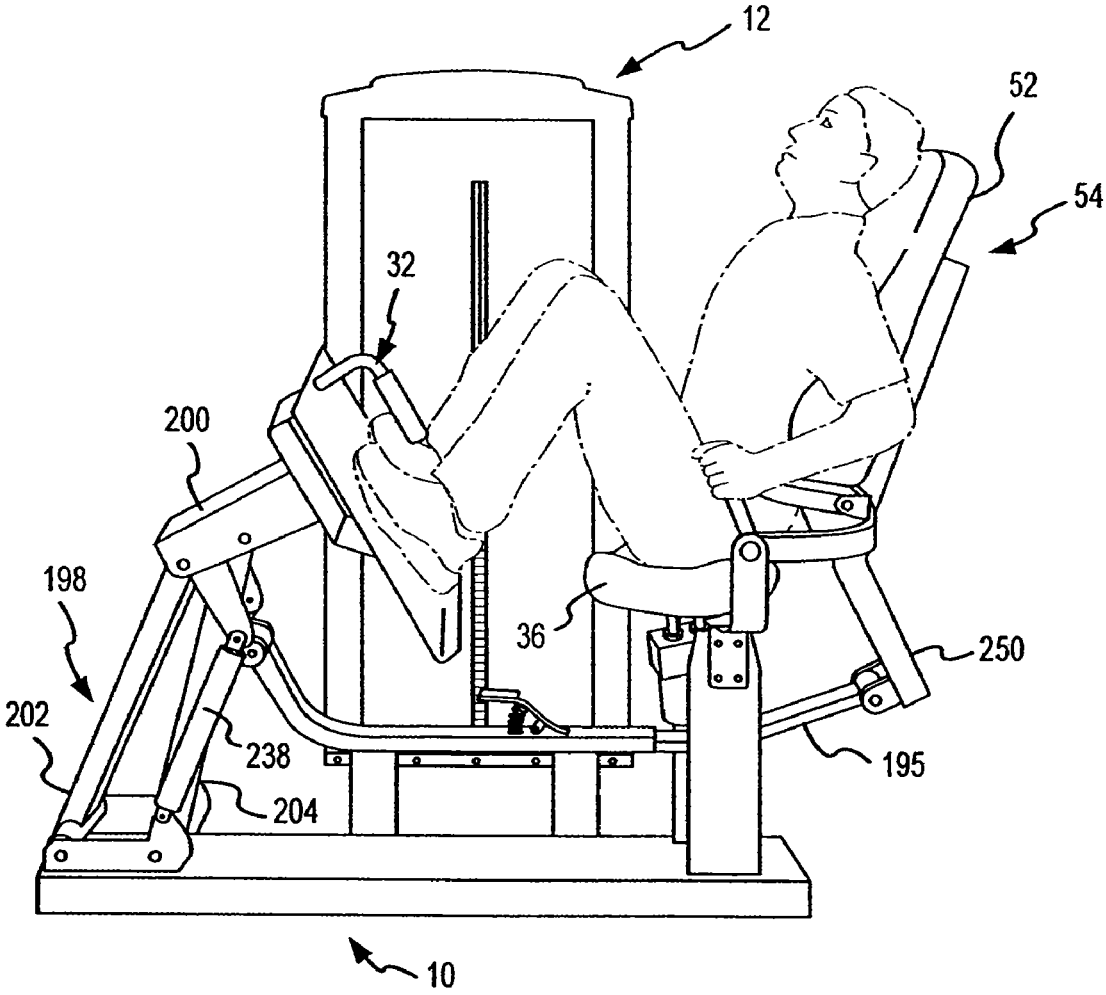
FIG. 8 is a side view of the exercise device with a body extension according to one embodiment of the present invention, the exercise device in an unextended position with a user seated therein.

Preferably, one end of the cable 108 is connected with the top of the weight selection bar 106 as mentioned above, and the other end of the cable 108 is connected with the main frame 10 adjacent the rear of the seat support post 34 using a retainer similar to the retention structure 110. A weight transfer pulley 312 is connected with the bottom of the rear portion 294 of the transfer link 195 with the axle of weight transfer pulley 312 transverse to the length of the transfer link. The first transfer pulley 44 is preferably connected with the seat support post 34, preferably with the axle of the first transfer pulley 44 connected between the left post bracket 38 and the right post bracket 40. A second transfer pulley 314 is connected with the lower frame member 16, preferably with the axle of the second transfer pulley 314 connected between the left side 20 and the right side 22 of the lower frame member, and preferably below the first transfer pulley 44. A third transfer pulley 316 is also connected with the lower frame member 16, preferably with the axle of the third transfer pulley 316 connected between a bracket along the bottom of the frame member and the top of the frame member. In the most rearward position of the body extension illustrated in FIGS. 3 and 8, the weight transfer pulley 312 is generally aligned with the first 44 and second 314 transfer pulleys, and in the most forward or extended position of the body extension illustrated in FIGS. 4 and 9, the weight transfer pulley 312 is forward of the first and second transfer pulleys (44, 314).

The position of the weight transfer pulley 312 depends on the position of the footplate 32. In other words, as the footplate is pushed by the user, the transfer link 195 is moved with the footplate, which in turn moves the weight transfer pulley 312, which by actuating the cable 108 or belt, causes the selected load to be lifted. In the rest position the weight transfer pulley is positioned under the seat 36, and in the fully extended position, the weight transfer pulley is moved to be positioned well in front of, and generally between, the front and rear ends of the exercise machine.

Figure 4:
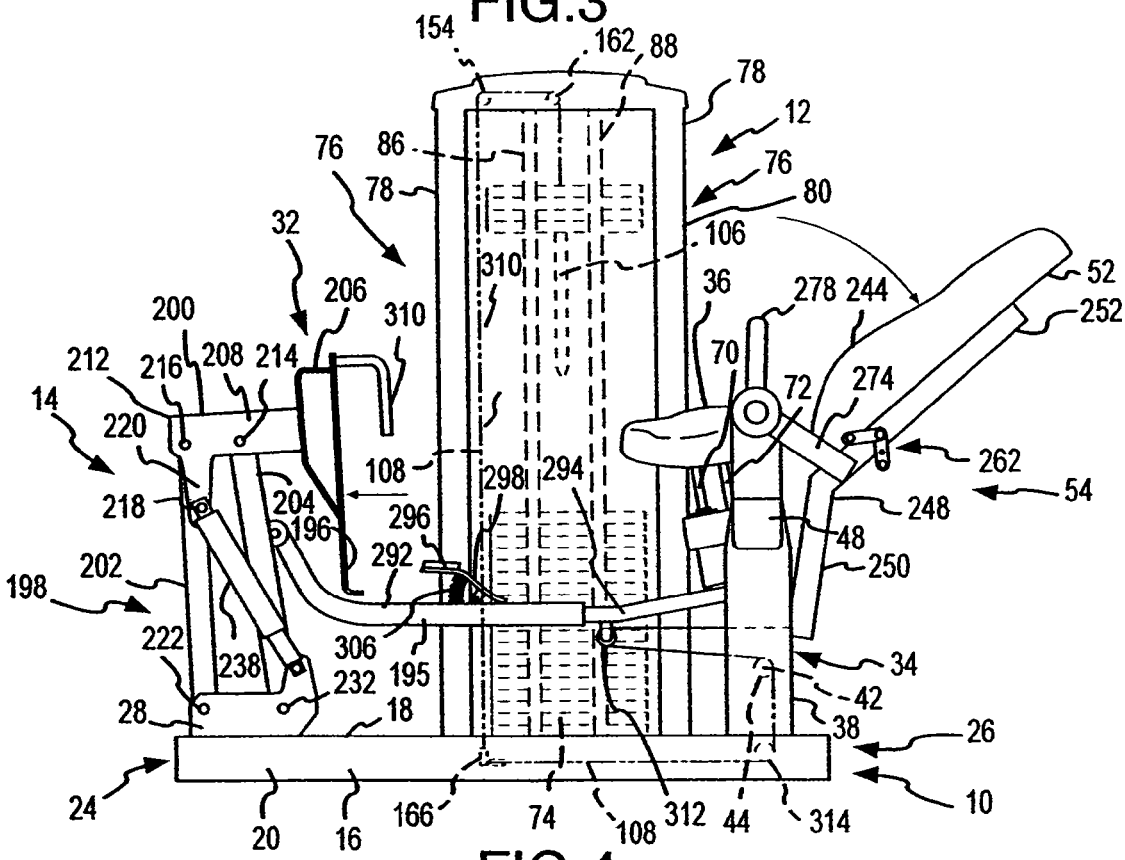
FIG. 4 is a side view of the exercise device with a body extension in an extended position according to one embodiment of the present invention.
Figure 7:
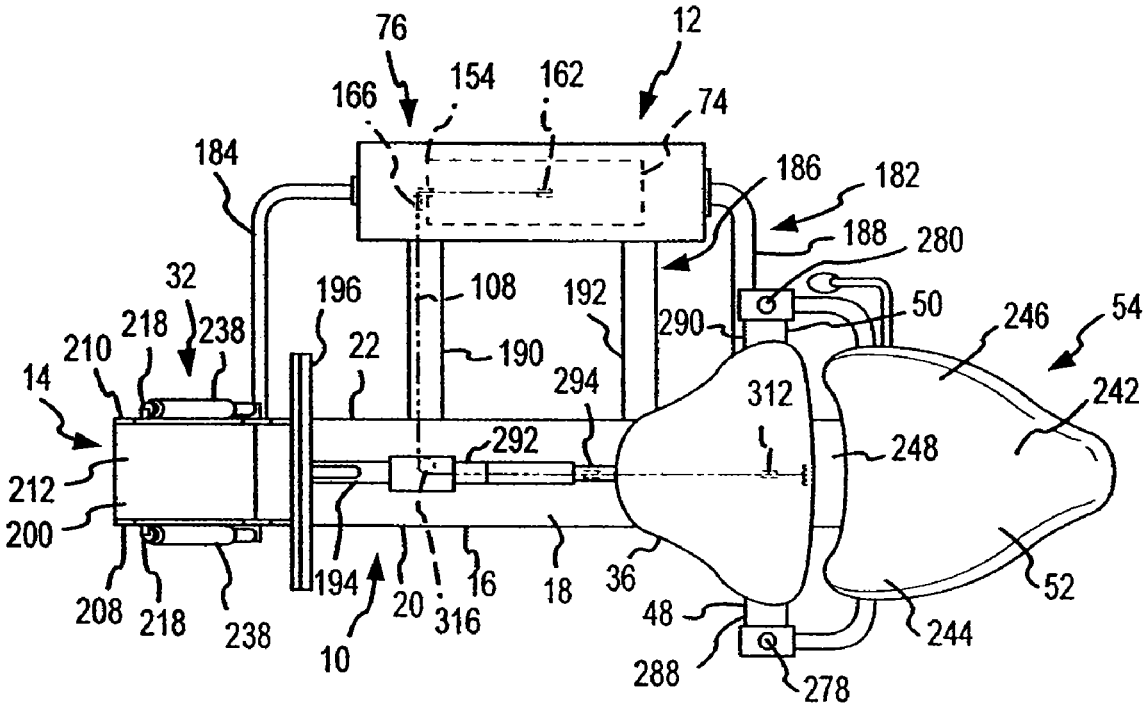
FIG. 7 is a top view of the exercise device with a body extension illustrating the cable path according to one embodiment of the present invention.
Figure 9:
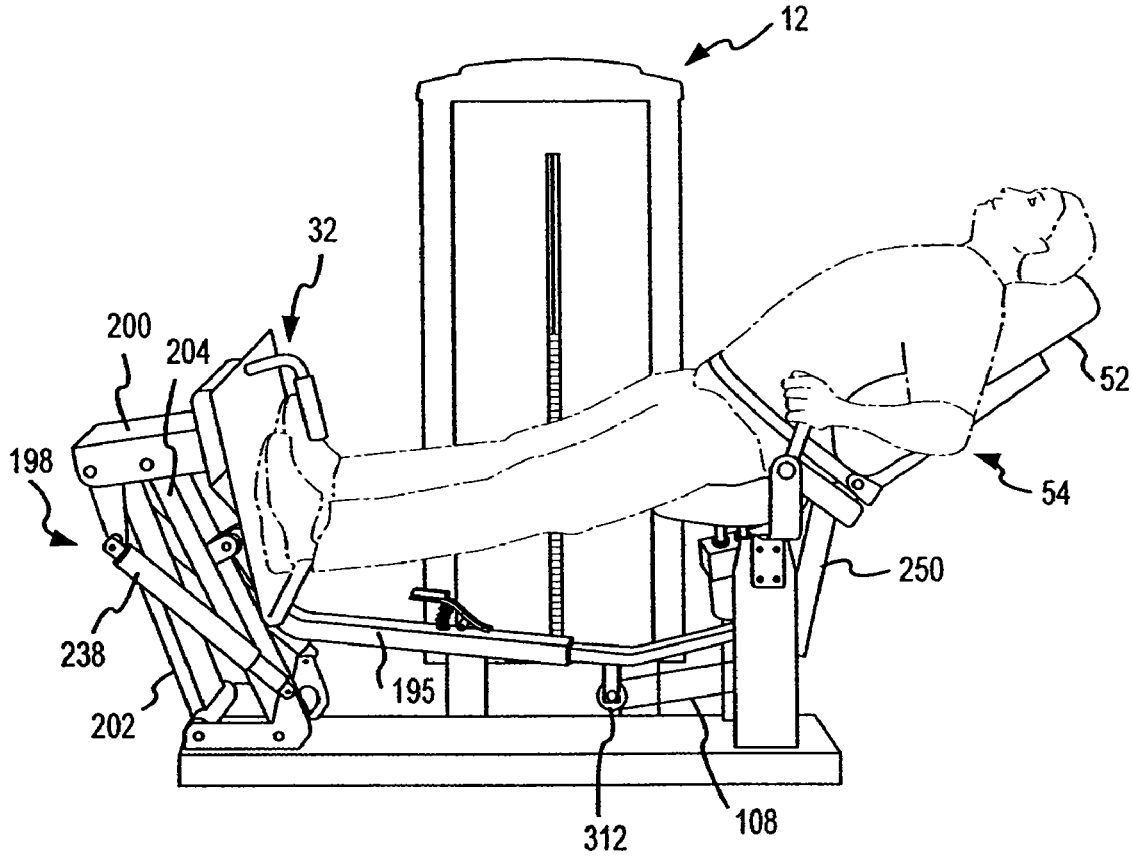
FIG. 9 is a side view of the exercise device with a body extension according to one embodiment of the present invention, the exercise device in an extended position with a user seated therein.

Referring to FIGS. 4 and 9 showing the extended position of the device, the cable 108 runs forwardly from the connection to the main frame 10 over the top of the weight transfer pulley 312. From the weight transfer pulley 312, the cable 108 runs rearwardly and engages the top and rear of the first transfer pulley 44. From the first transfer pulley 44, the cable 108 runs down and engages the rear and bottom of the second transfer pulley 314. From the second transfer pulley 314, the cable 108 runs forwardly along the length of the lower frame member 16 and engages the left side and front of the third transfer pulley 316. The third transfer pulley 316 is oriented transversely with regard to the second transfer pulley 314, and accordingly directs the cable 108 transversely to the length of the frame member toward the lower pulley 166 of the weight stack structure as best shown in FIGS. 1 and 7. The cable 108 engages the lower and right side of the lower pulley 166. From the lower pulley 166 the cable 108 is directed upward along the length of the weight stack structure 12 and engages the front and top of the front lift pulley 154. From the front lift pulley 154, the cable 108 extends rearwardly along the upper frame member 82 and engages the top and rear of the center lift pulley 162. From the center lift pulley 162 the cable extends downwardly generally along a longitudinal centerline of the weight stack structure 12 and is connected with the top of the weight selection bar 106.

The press plate mechanism 32 pivots forwardly when the user presses on the foot plate 196. The forward pivoting of the press plate mechanism 32 pulls the transfer link 195 forwardly. The forward movement of the transfer link 195 also moves the weight transfer pulley 312 forwardly. The cable 108 is fixed at its rear end to the main frame 10; accordingly, when the weight transfer link 195 moves forwardly, the forward force imparted by the user on the press plate 196 is substantially transferred via the pulley system to an upward force on the weight stack 74 where the front end of the cable 108 is fixed to the top of the weight stack selection bar 106. If the user, for example, uses the weight selection pin 122 to engage the fifth plate from the top of the weight stack 74, then when the user presses on the foot plate 196 the five selected plates will move upwardly along the guide members (86, 88).

In general, during operation, the use of the exercise machine of the present invention replicates the motion of lifting a box from the ground to ones torso. The user enters the machine and sits on the seat with their back against the back support. Their legs are bent at the hip with respect to the user's torso to an angle of approximately 90 degrees. Generally, the user's thigh and lower leg are bent at approximately a 90 degree angle. The user's feet contact the footplate, and extend at approximately right angles to the user's lower leg (depending on where the foot contacts the platform, this orientation could change a little bit). This is the "at rest" or "contracted" position. The user is in a "crouched" position, as if crouching down to pick up a box.

To reach the extended position, the user pushes on the footplate with its feet, causing the four-bar linkage to pivot with respect to the frame and move forwardly of the machine. As this happens, the user's legs straighten out, and lower slightly until the fully extended position. During the transition between the contracted position to the extended position, the transfer link is moved forwardly with respect to the frame and seat, and actuates the belt or cable system to lift the load. The rear end of the transfer link also moves forward and actuates the seat structure to pivot the seat support rearwardly. The seat portion itself does not move. This action causes the user's body to straighten out and basically aligns the lower legs, upper legs and torso in a linear orientation (as if one stood up). The seat back, when tilted back, does not extend parallel to the seat, but instead maintains a slight angle therewith. This exercise is repeated several times to exercise the many muscles used in the natural motion of picking objects up off of a floor.

While the invention has been described in conjunction with the specific embodiments outlined above, it is evident that many alternatives, modifications, and variations will be apparent to those skilled in the art. Accordingly, the preferred embodiments of the invention are intended to be illustrative and not limiting. Various changes may be made without departing from the spirit and scope of the invention as defined in the following claims.

We claim:

1. An exercise device comprising:

a frame;

a body extension mechanism including:

a press plate mechanism comprising a foot press plate and a four-bar linkage, the press plate mechanism operably connected to the frame;

the four-bar linkage including a top link, a front link pivotally connected to the top link, and a rear link pivotally connected to the top link;

the foot press plate connected to the top link;

the rear link pivotally connected to the top link rearward the pivotal connection of the front link to the top link;

the foot press plate connected to the top link rearward the pivotal connection of the rear link to the top link;

a seat structure positioned rearward of the press plate mechanism and including a seat and a back support, the back support being pivotally connected with the frame; and a transfer link including a first end and a second end, the first end being operably connected with the press plate mechanism, and the second end being operably connected with the back support so that movement of the press plate mechanism is coordinated with movement of the back support.

2. The exercise device of claim 1, wherein the press plate mechanism includes at least one of the front link and the rear link pivotally connected with the frame.

3. The exercise device of claim 1, further comprising at least one shock operably connected between said press plate mechanism and said frame.

4. The exercise device of claim 1, wherein:

said transfer link has a front portion defining a channel, and a rear link portion;

said rear link portion being insertable in the channel so that the length of the transfer link is adjustable.

5. The exercise device as defined in claim 1, further comprising:

a weight stack having at least one weight plate.

6. The exercise device as defined in claim 5, further comprising:

a cable operably connected between the body extension mechanism and the weight stack.

7. The exercise device as defined in claim 1, further comprising:

a weight stack having at least one moveable weight plate;

a cable operably connected between the body extension mechanism and said moveable weight plate; and wherein the movement of said body extension mechanism causes said transfer link to move, thus tensioning said cable to move said at least one weight plate and causing said back support to pivot about its connection with said frame.

8. An exercise device comprising:

a frame;

a foot press plate mechanism including a foot press plate, the foot press plate mechanism pivotally connected with the frame via a four-bar linkage;

the four-bar linkage including a top link, a first link pivotally connected with the top link and pivotally connected with the frame, and a second link pivotally connected with the top link and pivotally connected with the frame;

the second link pivotally connected to the top link rearward the pivotal connection of the first link to the top link;

the foot press plate connected to the top link rearward the pivotal connection of the second link to the top link; and a seat structure positioned rearward the foot press plate mechanism and including a pivotal back support and operably associated with the foot press plate mechanism so that movement of the seat structure is coordinated with the movement of the foot press plate.

9. The exercise device of claim 8, further comprising a weight stack operably connected with at least one of the foot press plate mechanism and the seat structure.

10. The exercise device of claim 8, wherein operably associating the foot press plate mechanism with the seat structure comprises a transfer link including a first portion pivotally connected with the foot press plate mechanism and a second portion pivotally connected with the pivotal back support.

11. The exercise device of claim 10, wherein the transfer link has an adjustable length.

12. The exercise device of claim 10, further comprising:

a body extension mechanism including:

the foot press plate;

the seat structure; and the transfer link.

13. The exercise device of claim 10, further comprising a weight stack operably connected with the transfer link.

14. An exercise device comprising:

a frame;

a foot press plate operably associated with a four-bar linkage, the foot press plate including a foot press plate rest position and at least a second foot press plate position;

the four-bar linkage including a top link, a front link pivotally connected to the top link, and a rear link pivotally connected to the top link;

the foot press plate connected to the top link;

the rear link pivotally connected to the top link rearward the pivotal connection of the front link to the top link;

the foot press plate connected to the top link rearward the pivotal connection of the rear link to the top link;

a seat structure positioned rearward the foot press plate and including a seat structure rest position and at least a second seat structure position; and wherein movement of the foot press plate between the foot press plate rest position and the at least a second foot press plate position is coordinated with movement of the seat structure between the seat structure rest position and the at least a second seat structure position.

15. The exercise device of claim 14, wherein the at least a second foot press plate position is further away from the seat structure than the foot press plate rest position.

16. The exercise device of claim 14, wherein the at least a second seat structure position is further away from the foot press plate than the seat structure rest position.

17. The exercise device of claim 14, wherein the seat structure includes a pivotal seat back, and the pivotal seat back pivots away from the foot press plate between the seat structure rest position and the at least a second seat structure position.

18. The exercise device of claim 14, further comprising a transfer link including a first portion pivotally connected with the foot press plate and a second portion pivotally connected with the seat structure.

19. An exercise device comprising:

a frame;

a body extension mechanism including:

a press plate mechanism operably connected to the frame;

a seat structure including a seat and a back support, the back support pivotally connected with the frame; and a transfer link operably connected with the press plate mechanism and operably connected with the back support so that movement of the press plate mechanism is coordinated with movement of the back support; and the press plate mechanism comprising:

a four-bar linkage comprising a top link including a front top link portion, a rear top link portion, and a middle top link portion between the front and rear top link portions, a front link pivotally connected with the frame, the front link pivotally connected to the front top link portion of the top link, a rear link pivotally connected to the middle top link portion of the top link, and the rear link pivotally connected with the frame rearwardly of the front link; and a foot press plate connected to the rear top link portion of the top link the foot press plate positioned between the middle tor link portion of the top link and the seat structure.

* * * * *